US011525565B1

(12) United States Patent
Liu

(10) Patent No.: US 11,525,565 B1
(45) Date of Patent: Dec. 13, 2022

(54) CHRISTMAS TREE STAND CONNECTING STRUCTURE AND LED DECORATIVE LAMP

(71) Applicant: Haitang Liu, Jingzhou (CN)

(72) Inventor: Haitang Liu, Jingzhou (CN)

(73) Assignee: Haitang Liu, Jingzhou (CN)

( * ) Notice: Subject to any disclaimer, the term of this patent is extended or adjusted under 35 U.S.C. 154(b) by 0 days.

(21) Appl. No.: 17/588,222

(22) Filed: Jan. 29, 2022

(30) Foreign Application Priority Data

Dec. 29, 2021 (CN) ..... 202123342233.4

(51) Int. Cl.

| | |
|---|---|
| ***F21V 23/06*** | (2006.01) |
| ***F21V 33/00*** | (2006.01) |
| ***F21W 121/04*** | (2006.01) |
| ***F21Y 115/10*** | (2016.01) |

(52) U.S. Cl.
CPC ..... *F21V 23/06* (2013.01); *F21V 33/0028* (2013.01); *F21W 2121/04* (2013.01); *F21Y 2115/10* (2016.08)

(58) Field of Classification Search
CPC ..... F21V 23/06; F21V 33/0028; F21S 6/004; F21W 2121/04; F21Y 2215/10
See application file for complete search history.

(56) References Cited

U.S. PATENT DOCUMENTS

| | | | | |
|---|---|---|---|---|
| 5,712,002 | A * | 1/1998 | Reilly, III | A47G 33/06 428/20 |
| 6,457,839 | B1 * | 10/2002 | Grandoit | A47G 33/06 362/122 |
| 10,441,014 | B1 * | 10/2019 | Chen | A41G 1/007 |
| 11,346,510 | B2 * | 5/2022 | Plissey | F21V 23/003 |
| 2010/0157598 | A1 * | 6/2010 | Tsai | F21V 21/002 362/382 |

* cited by examiner

*Primary Examiner* — Peggy A Neils
(74) *Attorney, Agent, or Firm* — Bayramoglu Law Offices LLC

(57) ABSTRACT

A Christmas tree stand connecting structure and an LED decorative lamp are disclosed. The Christmas tree stand connecting structure includes a fixed disc and an LED decorative lamp, wherein a side wall of the fixed disc is movably connected with a supporting frame. A top of the fixed disc is equipped with a connecting mechanism, wherein an angle adjusting assembly is arranged in the connecting mechanism. The connecting mechanism includes a connecting part, a positioning part, a connecting end, a connecting line, and a connecting port. The connecting part is assembled through the positioning part on a bottom of the connecting part and the positioning slot in a top. In a mounting process, a blocking part inside a matching slot is jacked to two sides through a semicircular structure on the top for a clamping part to clamp and fix a side wall of the blocking part.

5 Claims, 3 Drawing Sheets

CHRISTMAS TREE STAND CONNECTING STRUCTURE AND LED DECORATIVE LAMP

CROSS REFERENCE TO THE RELATED APPLICATIONS

This application is based upon and claims priority to Chinese Patent Application No. 202123342233.4 filed on Dec. 29, 2021, the entire contents of which are incorporated herein by reference.

TECHNICAL FIELD

The present invention relates to the technical field of Christmas trees, in particular to a Christmas tree stand connecting structure and an LED decorative lamp.

BACKGROUND

The Christmas tree is an evergreen tree that uses candles and ornaments to decorate a fir tree or an Oregon pine. As one of important components of the Christmas tree, the existing Christmas tree is mostly artificial, can be utilized for many times, is economical and environment-friendly.

The following defects or problems exist in the prior art:

Nowadays, a conventional Christmas tree stand connecting structure is mostly an assembly structure with a fixed height and a fixed style, so that the Christmas tree cannot be adjusted in height. As a result, the existing Christmas tree is not aesthetic and is uneasy to mount or dismount. In addition, the current connecting mechanism is unstable in mounting.

SUMMARY

To overcome the defects in the prior art, the present invention provides a Christmas tree stand connecting structure and an LED decorative lamp to solve the problems in the background art.

To achieve the objective, the present invention adopts a following scheme:

According to the Christmas tree stand connecting structure and the LED decorative clamp, the Christmas tree stand connecting structure includes a fixed disc and an LED decorative lamp, where the side wall of the fixed disc is movably connected with a supporting frame, and the top of the fixed disc is equipped with a connecting mechanism in which an angle adjusting assembly is arranged. The connecting mechanism includes a connecting part, a positioning part, a connecting end, a connecting line and a connecting port. The connecting part is mounted inside the fixed disc, the positioning part is fixedly connected on the bottom of the connecting part, a positioning slot is formed in the top of the connecting part, and the positioning part is matched with the positioning slot. The connecting end is fixedly connected inside the positioning slot, and the connecting line is fixedly connected with the connecting end. The connecting line is positioned inside the positioning slot and the connecting port is fixedly connected to one end of the connecting line. The connecting port is positioned on the side wall of the connecting part, and is matched with the LED decorative lamp.

Optionally, a connecting slot which is matched with the connecting end is formed in the bottom of the positioning part; and a groove which is matched with the connecting line is formed in the bottom of the positioning part.

Optionally, the connecting mechanism further includes a fixing part, a button, a connecting rod, a positioning rod and a clamping part. The fixing part is fixedly connected inside the positioning slot, and the button is movably connected inside the connecting part. The connecting rod is fixedly connected to one side of the button. The clamping part is fixedly connected to one side of the connecting rod and is connected inside the fixing part in a sliding mode. A limiting slot is formed inside the fixing part. One end of the positioning rod is fixedly connected to the inner wall of the positioning slot, and is connected inside the connecting rod in a sliding mode.

Optionally, the connecting mechanism further includes a blocking part. A limiting slot is formed inside the fixing part, and a matching slot matched with the fixing part is formed inside the positioning part. The blocking part is fixedly connected to the inner wall of the matching slot. The blocking part is matched with the limiting slot, and the clamping part is matched with the blocking part.

Optionally, the angle adjusting assembly includes an adjusting rod, a supporting plate and a mounting end. The supporting plate is fixedly connected to the side wall of the connecting part. The adjusting rod is rotatably connected inside the supporting plate. The mounting end is fixedly connected to the side wall of the adjusting rod and is positioned at one side of the supporting plate.

Optionally, the angle adjusting assembly further includes a fixing rod and a mounting plate. The fixing rod is movably connected inside the supporting plate, and the mounting plate is fixedly connected to the side wall of the fixing rod. A spring is fixedly connected between one side of the mounting plate and the interior of the supporting plate. A fixing slot which is matched with the fixing rod is formed in the side wall of the adjusting rod.

Compared with the prior art, the present invention provides a Christmas tree stand connecting structure and an LED decorative lamp, which have the following beneficial effects:

Firstly, the connecting mechanism is arranged, so that the connecting part is assembled through the positioning part on the bottom of the connecting part and the positioning slot in the top of the connecting part. In a mounting process, the blocking part inside the matching slot jacks the clamping part to the two sides through the semicircular structure on the top, so that the clamping part can clamp and fix the side wall of the blocking part, the connecting part is mounted more stably, and is prevented from dropping.

Secondly, the angle adjusting assembly is arranged and the mounting end is arranged on the side wall of the adjusting rod, so that the adjusting rod can control the mounting end to rotate to adjust the angle. The fixing slot is formed in the side wall of the adjusting rod, so that the fixing rod can fix the adjusting rod through the fixing slot. In such a manner, angles of branches of the Christmas tree are adjusted, so that the appearance of the Christmas tree is various.

BRIEF DESCRIPTION OF THE DRAWINGS

In order to explain the technical solutions in the embodiments of the present invention or the prior art more clearly, the drawings used in the embodiments or the prior art will be briefly introduced below. Obviously, the drawings in the following description are some embodiments of the present invention. For a person of ordinary skill in the art, other drawings can be obtained based on these drawings without paying creative labor.

Figure 1:
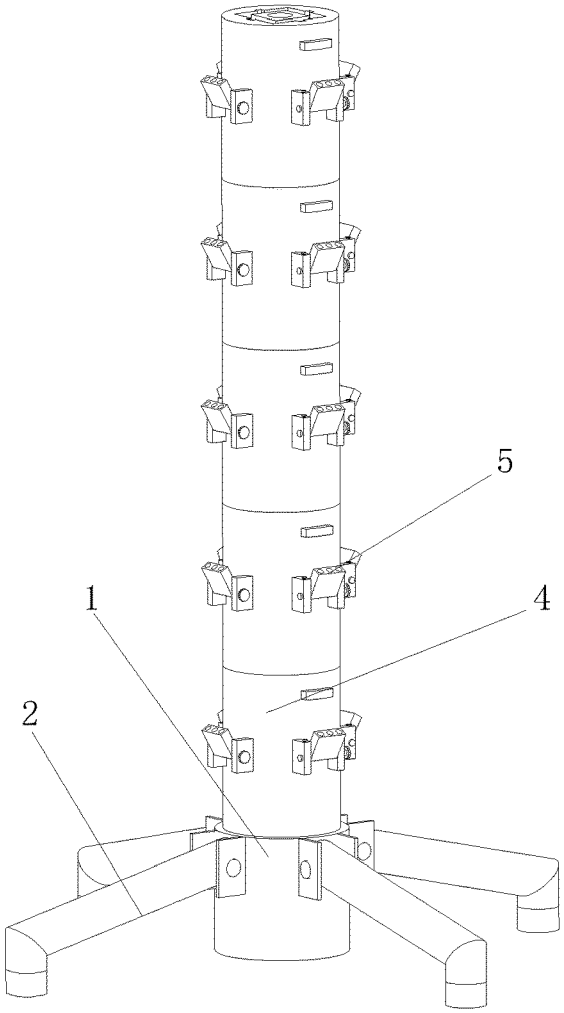
FIG. 1 is a structural diagram of the present invention.

In the figures: 1, fixed disc; 2, supporting frame; 3, button; 4, connecting part; 5, mounting end; 6, positioning slot; 7, positioning part; 8, fixing part; 9, limiting slot; 10, supporting plate; 11, connecting rod; 12, adjusting rod; 13, connecting port; 14, connecting end; 15, connecting line; 16, fixing rod; 17, spring; 18, positioning rod; 19, clamping part; 20, fixing slot; 21, mounting plate; 22, blocking part; and 23, LED decorative lamp.

DETAILED DESCRIPTION OF THE EMBODIMENTS

The technical solutions in the embodiments of the present invention will be described clearly and completely in combination with the drawings in the embodiments of the present invention. Obviously, the described embodiments are part of, but not all of, the embodiments of the present invention. Based on the embodiments in the present invention, all other embodiments obtained by a person of ordinary skill in the art without creative efforts shall fall within the protection scope of the present invention.

In the description of the present invention, it is to be understood that orientation or position relationships indicated by terms "vertical", "upper", "lower", "horizontal" and the like are orientation or the position relationships shown in the drawings, are adopted not to indicate or imply that indicated devices or the components must be in specific orientations or structured and operated in specific orientations but only to conveniently describe the present invention and simplify the description, and thus should not be understood as limits to the present invention.

Figure 2:
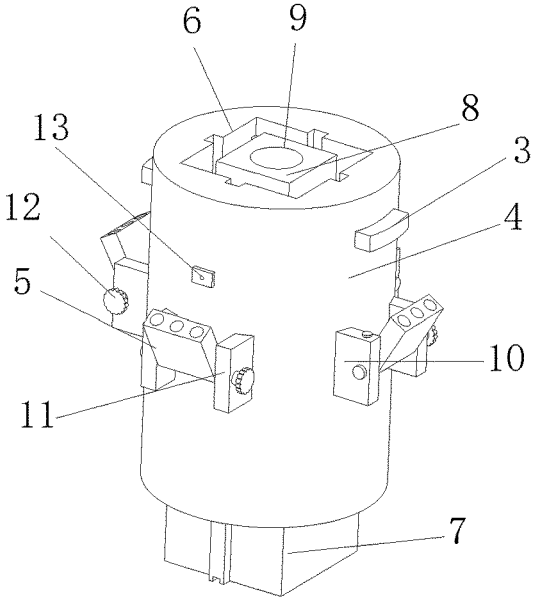
FIG. 2 is a structural diagram of a connecting part of the present invention.
Figure 3:
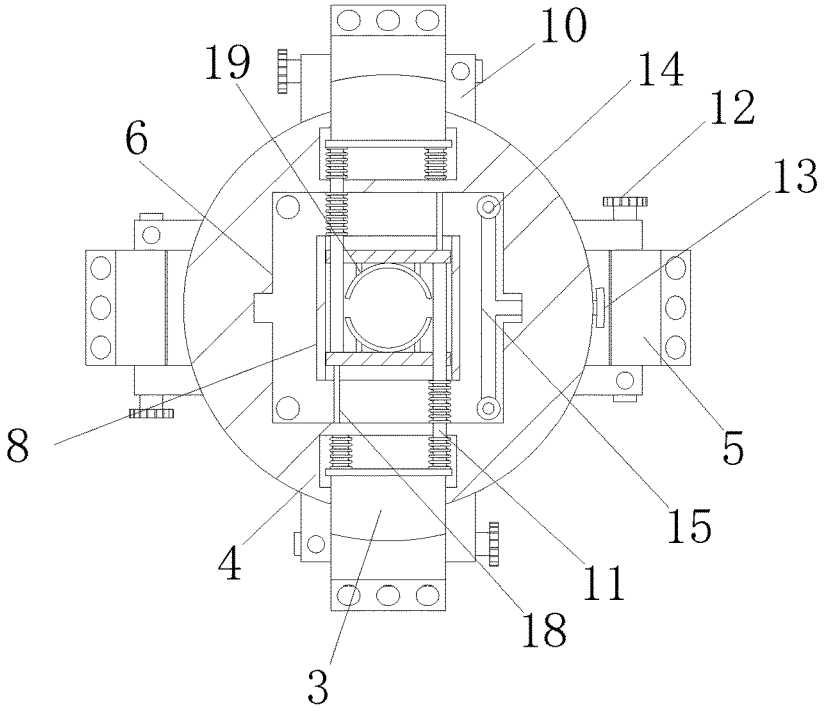
FIG. 3 is a top view of the connecting part shown in FIG. 2.
Figure 4:
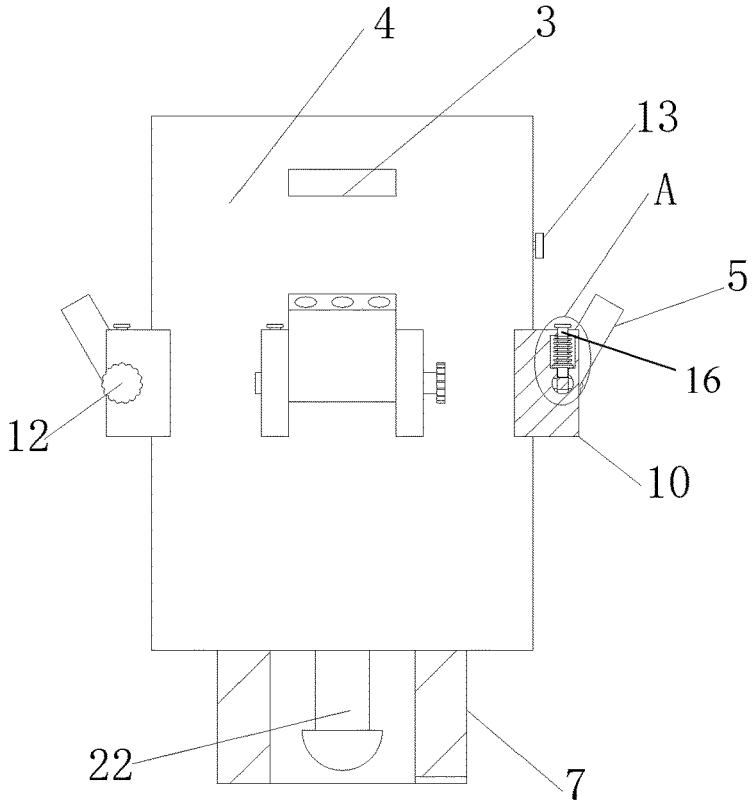
FIG. 4 is a side view of the connecting part shown in FIG. 2, with the blocking part 22 and the area A containing the fixing rod 16 revealed.
Figure 5:
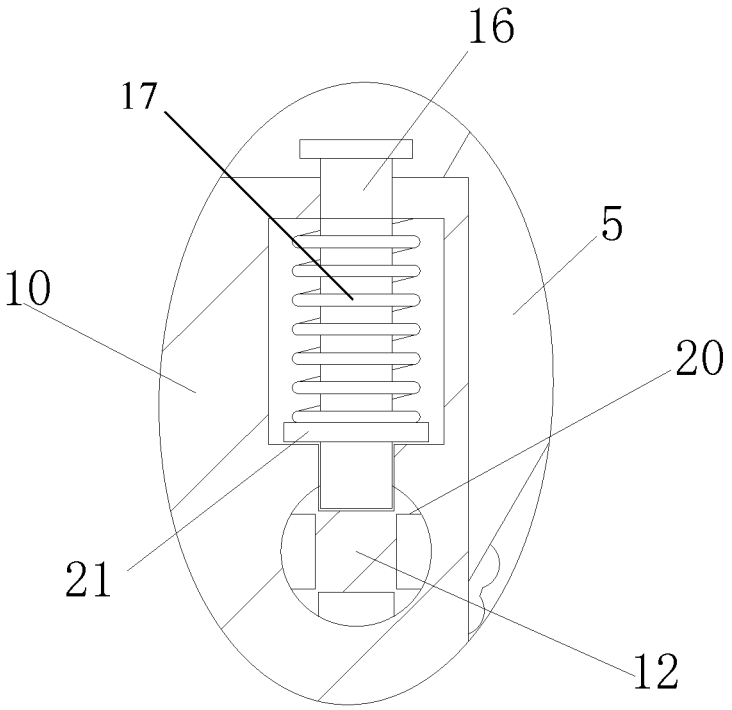
FIG. 5 is a partially enlarged view showing the area A in FIG. 4 of the present invention.
Figure 6:
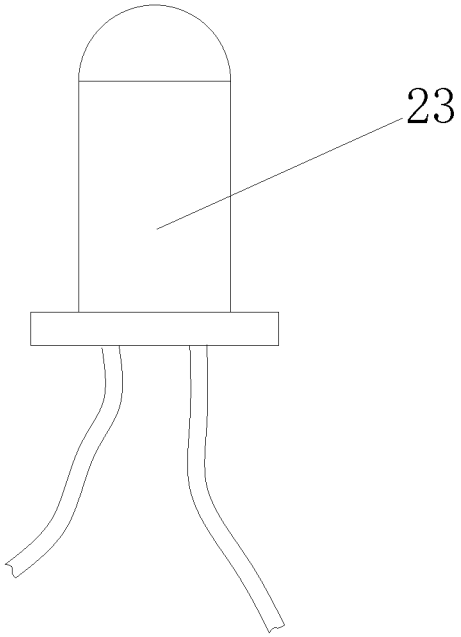
FIG. 6 is a structural diagram of an LED decorative clamp of the present invention.

Referring to FIG. 1 to FIG. 6, in the embodiment, according to a Christmas tree stand connecting structure and a LED decorative clamp, the Christmas tree stand connecting structure includes a fixed disc 1 and an LED decorative lamp 23, where the side wall of the fixed disc 1 is movably connected with a supporting frame 2, and the top of the fixed disc 1 is equipped with a connecting mechanism in which an angle adjusting assembly is arranged. The connecting mechanism includes a connecting part 4, a positioning part 7, a connecting end 14, a connecting line 15 and a connecting port 13. The connecting part 4 is mounted inside the fixed disc 1, the positioning part 7 is fixedly connected on the bottom of the connecting part 4, a positioning slot 6 is formed in the top of the connecting part 4, and the positioning part 7 is matched with the positioning slot 6. The connecting end 14 is fixedly connected inside the positioning slot 6, and the connecting line 15 is fixedly connected with the connecting end 14. The connecting line 15 is positioned inside the positioning slot 6 and the connecting port 13 is fixedly connected to one end of the connecting line 15. The connecting port 13 is positioned on the side wall of the connecting part 4, and is matched with the LED decorative lamp 23. The fixed disc 1 can be used as a base of the Christmas tree. The supporting frame 2 is fixedly mounted on the side wall of the movable shaft which moves inside the connecting frame; the supporting frame 2 is movably connected onto the side wall of the fixed disc 1 through the connecting frame, so that the fixed disc 1 is more stable; the supporting frame 2 can be folded through the movable shaft in the connecting frame on the side wall of the fixed disc 1, so that the fixed disc 1 is conveniently stored. The mounting end 5 can be arranged for mounting branches of the Christmas tree therein.

A connecting slot which is matched with the connecting end 14 is formed in the bottom of the positioning part 7, and a groove which is matched with the connecting line 15 is formed in the bottom of the positioning part 7. The positioning part 7 is arranged, so that the connecting part 4 can be assembled through the positioning part 7 on the bottom and the positioning slot 6 in the top. The height of the Christmas tree can be freely adjusted by mounting different numbers of connecting parts 4.

The connecting mechanism further includes a fixing part 8, a button 3, a connecting rod 11, a positioning rod 18 and a clamping part 19. The fixing part 8 is fixedly connected inside the positioning slot 6 and the button 3 is movably connected inside the connecting part 4. The connecting rod 11 is fixedly connected to one side of the button 3. The clamping part 19 is fixedly connected to one side of the connecting rod 11 and is connected inside the fixing part 8 in a sliding mode. A limiting slot 9 is formed inside the fixing part 8, and one end of the positioning rod 18 is fixedly connected to the inner wall of the positioning slot 6, and the positioning rod 18 is connected inside the connecting rod 11 in a sliding mode. The button 3 can be pressed, so that the connecting rod 11 drives the clamping rod 19 to move to one side.

The connecting mechanism further includes a blocking part 22, and a limiting slot 9 is formed inside the fixing part 8. A matching slot matched with the fixing part 8 is formed inside the positioning part 7, and the blocking part 22 is fixedly connected to the inner wall of the matching slot. The blocking part 22 is matched with the limiting part 9, and the clamping part 19 is matched with the blocking part 22. The blocking part 22 and the clamping part 19 are arranged, so that mounting is more stable and firmer.

The angle adjusting assembly includes an adjusting rod 12, a supporting plate 10 and a mounting end 5. The supporting plate 10 is fixedly connected to the side wall of the connecting part 4 and the adjusting rod 12 is rotatably connected inside the supporting plate 10. The mounting end 5 is fixedly connected to the side wall of the adjusting rod 12 and is positioned at one side of the supporting plate 10. The mounting end 5 is arranged on the side wall of the adjusting rod 12, so that the adjusting rod 12 can control the mounting end 5 to rotate to adjust the angle.

The angle adjusting assembly further includes a fixing rod 16 and a mounting plate 21. The fixing rod 16 is movably connected inside the supporting plate 10 and the mounting plate 21 is fixedly connected to the side wall of the fixing rod 16. A spring 17 is fixedly connected between one side of the mounting plate 21 and the interior of the supporting plate 10, and a fixing slot 20 which is matched with the fixing rod 16 is formed in the side wall of the adjusting rod 12. The fixing slot 20 is formed in the side wall of the adjusting rod 12, so that the fixing rod 16 can fix the adjusting rod 12 through the fixing slot 20 to prevent the adjusting rod 12 from rotating.

The working principle and the use process of the present invention are: when the Christmas tree needs to use, the fixed disc 1 can be arranged as a base of the Christmas tree; the supporting frame 2 is arranged for making the fixed disc 1 more stable;

the connecting part 4 is assembled through the positioning part 7 on the bottom of the connecting part 4 and the positioning slot 6 in top; the height of the Christmas tree can be freely adjusted by mounting different numbers of connecting parts 4. In the mounting process, the blocking part 22 inside the matching slot jacks the clamping plate 19 to the two sides through the semicircular structure on the top. The clamping part 19 can clamp and fix the side wall of the blocking part 22, so that the connecting part 4 is mounted more stably and is prevented from dropping. The mounting end 5 is arranged on the side wall of the adjusting rod 12, so that the adjusting rod 12 can control the mounting end 5 to rotate to adjust the angle. The mounting end 5 can be arranged for mounting the branches of the Christmas tree inside the mounting end 5, so that the angles of the branches of the Christmas tree are adjusted. Each connecting part 4 can be electrified through the connecting end 14 and the connecting line 15 inside therein. The connecting port 13 is arranged, so that the decorative LED lamp can be mounted inside the connecting port 13, electric lines are prevented from being directly arranged on the branches of the Christmas tree, and the Christmas tree can be decorated to be more attractive.

The above are only preferred embodiments of the present invention and are not intended to limit the present invention. Any equivalent structure modification made according to the contents of the specification and accompanying drawings in the present invention, under the concept of the present invention, no matter whether it is directly or indirectly used in any other related technical field, should be included within the protection scope of the present invention.

What is claimed is:

1. A Christmas tree stand connecting structure, wherein the Christmas tree stand connecting structure comprises a fixed disc and an LED decorative lamp;

a side wall of the fixed disc is movably connected with a supporting frame;

the top of the fixed disc is equipped with a connecting mechanism, wherein an angle adjusting assembly is arranged in the connecting mechanism;

the connecting mechanism comprises a connecting part, a positioning part, a connecting end, a connecting line and a connecting port, wherein the connecting part is mounted inside the fixed disc;

the positioning part is fixedly connected on a bottom of the connecting part;

a positioning slot is formed in a top of the connecting part;

the positioning part is matched with the positioning slot;

the connecting end is fixedly connected inside the positioning slot;

the connecting line is fixedly connected with the connecting end;

the connecting line is positioned inside the positioning slot;

the connecting port is fixedly connected to one end of the connecting line;

the connecting port is positioned in a side wall of the connecting part; and the LED decorative lamp is mounted inside the connecting port.

2. The Christmas tree stand connecting structure according to claim 1, wherein the connecting mechanism further comprises a fixing part, a button, a connecting rod, a positioning rod and a clamping part;

the fixing part is fixedly connected inside the positioning slot;

the button is movably connected inside the connecting part;

the connecting rod is fixedly connected to one side of the button;

the clamping part is fixedly connected to one side of the connecting rod;

the clamping part is connected inside the fixing part in a sliding mode;

a limiting slot is formed inside the fixing part;

one end of the positioning rod is fixedly connected to an inner wall of the positioning slot; and the positioning rod is connected inside the connecting rod in the sliding mode.

3. The Christmas tree stand connecting structure according to claim 2, wherein the connecting mechanism further comprises a blocking part;

the blocking part is fixedly connected on an inner wall of the matching slot;

the blocking part is matched with the limiting slot; and the clamping part is matched with the blocking part.

4. The Christmas tree stand connecting structure according to claim 1, wherein the angle adjusting assembly comprises an adjusting rod, a supporting plate and a mounting end;

the supporting plate is fixedly connected on the side wall of the connecting part;

the adjusting rod is rotatably connected inside the supporting plate;

the mounting end is fixedly connected on a side wall of the adjusting rod; and the mounting end is positioned at one side of the supporting plate.

5. The Christmas tree stand connecting structure according to claim 4, wherein the angle adjusting assembly further comprises a fixing rod and a mounting plate;

the fixing rod is movably connected inside the supporting plate;

the mounting plate is fixedly connected on a side wall of the fixing rod;

a spring is fixedly connected between one side of the mounting plate and an interior of the supporting plate;

a fixing slot is formed in the side wall of the adjusting rod; and the fixing slot is matched with the fixing rod.

* * * * *